US008886526B2

(12) United States Patent
Yoo et al.

(10) Patent No.: US 8,886,526 B2
(45) **Date of Patent: *Nov. 11, 2014**

(54) SOURCE SEPARATION USING INDEPENDENT COMPONENT ANALYSIS WITH MIXED MULTI-VARIATE PROBABILITY DENSITY FUNCTION

(75) Inventors: Jaekwon Yoo, Foster City, CA (US); Ruxin Chen, Redwood City, CA (US)

(73) Assignee: Sony Computer Entertainment Inc., Tokyo (JP)

( * ) Notice: Subject to any disclaimer, the term of this patent is extended or adjusted under 35 U.S.C. 154(b) by 289 days.

This patent is subject to a terminal disclaimer.

(21) Appl. No.: 13/464,833

(22) Filed: May 4, 2012

(65) Prior Publication Data

US 2013/0297298 A1 Nov. 7, 2013

(51) Int. Cl.
*G10L 21/02* (2013.01)

(52) U.S. Cl.
USPC ..... 704/226; 704/227; 704/228

(58) Field of Classification Search
CPC ..... G10L 21/0272; G10L 21/0208; G10L 2021/02165; G10L 2021/02166; G10L 21/02
USPC ..... 704/226–228
See application file for complete search history.

(56) References Cited

U.S. PATENT DOCUMENTS

| | | | | |
|---|---|---|---|---|
| 6,266,636 | B1 | 7/2001 | Kosaka et al. | |
| 6,622,117 | B2 * | 9/2003 | Deligne et al. | 702/190 |
| 7,797,153 | B2 | 9/2010 | Hiroe | |
| 7,912,680 | B2 | 3/2011 | Shirakawa | |
| 7,921,012 | B2 | 4/2011 | Fujimura et al. | |
| 8,249,867 | B2 * | 8/2012 | Cho et al. | 704/233 |
| 2007/0021958 | A1 | 1/2007 | Visser et al. | |
| 2007/0185705 | A1 * | 8/2007 | Hiroe | 704/200 |
| 2007/0280472 | A1 | 12/2007 | Stokes, III et al. | |
| 2008/0107281 | A1 * | 5/2008 | Togami et al. | 381/66 |
| 2008/0122681 | A1 | 5/2008 | Shirakawa | |
| 2008/0219463 | A1 * | 9/2008 | Liu et al. | 381/66 |
| 2008/0228470 | A1 * | 9/2008 | Hiroe | 704/200 |
| 2009/0089054 | A1 | 4/2009 | Wang et al. | |
| 2009/0222262 | A1 * | 9/2009 | Kim et al. | 704/231 |
| 2009/0304177 | A1 | 12/2009 | Burns et al. | |
| 2009/0310444 | A1 * | 12/2009 | Hiroe | 367/125 |
| 2011/0261977 | A1 * | 10/2011 | Hiroe | 381/119 |
| 2013/0144616 | A1 * | 6/2013 | Bangalore | 704/226 |
| 2013/0156222 | A1 * | 6/2013 | Lee et al. | 381/93 |
| 2013/0272548 | A1 * | 10/2013 | Visser et al. | 381/122 |

OTHER PUBLICATIONS

Benesty, J.; Amand, F.; Gilloire, A.; Grenier, Y., "Adaptive filtering algorithms for stereophonic acoustic echo cancellation," Acoustics, Speech, and Signal Processing, 1995. ICASSP-95., 1995 International Conference on , vol. 5, No., pp. 3099,3102 vol. 5, May 9-12, 1995.

(Continued)

*Primary Examiner* — Douglas Godbold
(74) *Attorney, Agent, or Firm* — Joshua D. Isenberg; JDI Patent

(57) ABSTRACT

Methods and apparatus for signal processing are disclosed. Source separation can be performed to extract source signals from mixtures of source signals by way of independent component analysis. Source separation described herein involves mixed multivariate probability density functions that are mixtures of component density functions having different parameters corresponding to frequency components of different sources, different time segments, or some combination thereof.

36 Claims, 4 Drawing Sheets

(56) References Cited

OTHER PUBLICATIONS

Benesty, Jacob, Pierre Duhamel, and Yves Grenier. "Multi-Channel Adaptive Filtering Applied to Multi-Channel Acoustic Echo Cancellation." (1996): n. pag. Print.
Benesty, Jacob, Thomas Gansler, Yiteng Arden Huang, and Markus Rupp. "Adaptive Algorithsm for MIMO Acoustic Echo Cancellation." (2004): 119-47. Print.
Buchner, H.; Kellermann, W., "A Fundamental Relation Between Blind and Supervised Adaptive Filtering Illustrated for Blind Source Separation and Acoustic Echo Cancellation," Hands-Free Speech Communication and Microphone Arrays, 2008. HSCMA 2008 , vol., No., pp. 17,20, May 6-8, 2008.
Buchner, Herbert, "Acoustic Echo Cancellation for Multiple Reproduction Channels: From First Principles to Real-Time Solutions," Voice Communication (SprachKommunikation), 2008 ITG Conference on , vol., No., pp. 1,4, Oct. 8-10, 2008.
H.Sawada, R.Mukai, S.Araki and S.Makino, "Solving Permutation and Circularity problem in Frequency-Domain Blind Source Separation," Proc. International Conf. on ICA 2004, Japan.
Hao, Jiucang, Intae Lee, Te-Won Lee, and Terrence J. Sejnowski. "Independent Vector Analysis for Source Separation Using a Mixture of Gaussians Prior." Neural Computation 22.6 (2010): 1646-673. Print.
Hioka, Y.; Niwa, K.; Sakauchi, S.; Furuya, K.; Haneda, Y., "Estimating Direct-to-Reverberant Energy Ratio Using D/R Spatial Correlation Matrix Model," Audio, Speech, and Language Processing, IEEE Transactions on , vol. 19, No. 8, pp. 2374,2384, Nov. 2011.
Huillery, J.; Millioz, F.; Martin, N., "On the Probability Distributions of Spectrogram Coefficients for Correlated Gaussian Process," Acoustics, Speech and Signal Processing, 2006. ICASSP 2006 Proceedings. 2006 IEEE International Conference on , vol. 3, No., pp. III,III, May 14-19, 2006.
Hyvarinen, Aapo, and Erkki Oja. "Independent Component Analysis: Algorithms and Applications." Neural Networks (2000): 411-30. Print.
Joho, Marcel, Heinz Mathis, and Russel H. Lambert. "Overdetermined Blind Source Separation: Using More Sensors Than Source Signals in a Noisy Mixture." Independent Component Analysis and Blind Signal Separation (2000): 81-86. Print.
Kawanabe, Motoaki, and Noboru Murata. "Independent Component Analysis in the Presence of Gaussian Noise." (2000): n. pag. Print.
Klumpp, V.; Hanebeck, U.D., "Bayesian estimation with uncertain parameters of probability density functions," Information Fusion, 2009. FUSION '09. 12th International Conference on , vol., No., pp. 1759,1766, Jul. 6-9, 2009.
Lee, Seonjoo, Haipeng Shen, Young Truong, Mechelle Lewis, and Xuemei Huang. "Independent Component Analysis Involving Autocorrelated Sources With an Application to Functional Magnetic Resonance Imaging." (2011): n. pag. Print.
Li, Huxiong, and Fan Gu. "A Blind Separation Algorithm for Speech in Strong Reverberation." Journal of Computational Information Systems (2010): n. pag. Print.
Malek, Jiri. "Blind Audio Source Separation via Independent Component Analysis." (2010): n. pag. Print.
Masaru Fujieda and Takahiro Murakami and Yoshihisa Ishida "An Approach to Solving a Permutation Problem of Frequency Domain Independent Component Analysis for Blind Source Separation of Speech Signal", International Journal of Biological and Life Sciences 1:4 2005.
Mukai, Ryo, Sawada, Shoko Araki, and Shoji Makino. "Real-Time Blind Source Separation for Moving Speech Signals." (2005): n. pag. Print.
Ngoc, Duong Quang K., Park Chul, and Seung-Hyon Nam. "An Acoustic Echo Canceller Combined With Blind Source Separation."
R. Mukai, H. Sawada, S. Araki, and S. Makino, "Real-Time blind source separation for moving speakers using blockwise ICA and residual crosstalk subtraction", Proc. Int. Symp. Independent Component Analysis Blind Signal Separation (ICA) , pp. 975-980 2003.
Reynolds, Douglas A. "Gaussian Mixture Models." (2009): 659-663.
Russell, Iain T., Jiangtao Xi, and Alfred Merlins. "Time Domain Blind Separation of Nonstationary Convolutively Mixed Signals." (2005): n. pag. Print.
Sawada, H.; Mukai, Ryo; Araki, S.; Makino, S., "A robust and precise method for solving the permutation problem of frequency-domain blind source separation," Speech and Audio Processing, IEEE Transactions on , vol. 12, No. 5, pp. 530,538, Sep. 2004.
Souden, M.; Zicheng Liu, "Optimal joint linear acoustic echo cancelation and blind source separation in the presence of loudspeaker nonlinearity," Multimedia and Expo, 2009. ICME 2009. IEEE International Conference on , vol., No., pp. 117,120, Jun. 28-Jul. 3, 2009
U.S. Appl. No. 13/464,828, entitled "Source Separation by Independent Component Analysis in Conjunction With Source Direction Information" to Jaekwon, Yoo, filed May 4, 2012.
U.S. Appl. No. 13/464,842, entitled "Source Separation by Independent Component Analysis in Conjuction With Optimization of Acoustic Echo Cancellation" to Jaekwon Yoo, filed May 4, 2012.
U.S. Appl. No. 13/464,848, entitled "Source Separation by Independent Component Analysis With Moving Constraint" to Jaekwon Yoo, filed May 4, 2012.
Yensen, T.; Goubran, R., "An acoustic echo cancellation structure for synthetic surround sound," Acoustics, Speech, and Signal Processing, 2001. Proceedings. (ICASSP '01). 2001 IEEE International Conference on , vol. 5, No., pp. 3237,3240 vol. 5, 2001.
Non-Final Office Action for U.S. Appl. No. 13/464,842, dated Jul. 22, 2014.
Non-Final Office Action for U.S. Appl. No. 13/464,828, dated Apr. 30, 2014.
Notice of Allowance for U.S. Appl. No. 13/464,828, dated Aug. 20, 2014.

* cited by examiner

SOURCE SEPARATION USING INDEPENDENT COMPONENT ANALYSIS WITH MIXED MULTI-VARIATE PROBABILITY DENSITY FUNCTION

CROSS-REFERENCE TO RELATED APPLICATIONS

This application is related to commonly-assigned, co-pending application Ser. No. 13/464,842, to Ruxin Chen, entitled SOURCE SEPARATION BY INDEPENDENT COMPONENT ANALYSIS IN CONJUNCTION WITH OPTIMIZATION OF ACOUSTIC ECHO CANCELLATION, filed the same day as the present application, the entire disclosures of which are incorporated herein by reference. This application is also related to commonly-assigned, co-pending application Ser. No. 13/464,828, to Ruxin Chen, entitled SOURCE SEPARATION BY INDEPENDENT COMPONENT ANALYSIS IN CONJUNCTION WITH SOURCE DIRECTION INFORMATION, filed the same day as the present application, the entire disclosures of which are incorporated herein by reference. This application is also related to commonly-assigned, co-pending application Ser. No. 13/464,848, to Ruxin Chen, entitled SOURCE SEPARATION BY INDEPENDENT COMPONENT ANALYSIS WITH MOVING RESTRAINT, filed the same day as the present application, the entire disclosures of which are incorporated herein by reference.

FIELD OF THE INVENTION

Embodiments of the present invention are directed to signal processing. More specifically, embodiments of the present invention are directed to audio signal processing and source separation methods and apparatus utilizing independent component analysis (ICA).

BACKGROUND OF THE INVENTION

Source separation has attracted attention in a variety of applications where it may be desirable to extract a set of original source signals from a set of mixed signal observations.

Source separation may find use in a wide variety of signal processing applications, such as audio signal processing, optical signal processing, speech separation, neural imaging, stock market prediction, telecommunication systems, facial recognition, and more. Where knowledge of the mixing process of original signals that produces the mixed signals is not known, the problem has commonly been referred to as blind source separation (BSS).

Independent component analysis (ICA) is an approach to the source separation problem that models the mixing process as linear mixtures of original source signals, and applies a de-mixing operation that attempts to reverse the mixing process to produce a set of estimated signals corresponding to the original source signals. Basic ICA assumes linear instantaneous mixtures of non-Gaussian source signals, with the number of mixtures equal to the number of source signals. Because the original source signals are assumed to be independent, ICA estimates the original source signals by using statistical methods extract a set of independent (or at least maximally independent) signals from the mixtures.

While conventional ICA approaches for simplified, instantaneous mixtures in the absence of noise can give very good results, real world source separation applications often need to account for a more complex mixing process created by real world environments. A common example of the source separation problem as it applies to speech separation is demonstrated by the well-known "cocktail party problem," in which several persons are speaking in a room and an array of microphones are used to detect speech signals from the separate speakers. The goal of ICA would be to extract the individual speech signals of the speakers from the mixed observations detected by the microphones; however, the mixing process may be complicated by a variety of factors, including noises, music, moving sources, room reverberations, echoes, and the like. In this manner, each microphone in the array may detect a unique mixed signal that contains a mixture of the original source signals (i.e. the mixed signal that is detected by each microphone in the array includes a mixture of the separate speakers' speech), but the mixed signals may not be simple instantaneous mixtures of just the sources. Rather, the mixtures can be convolutive mixtures, resulting from room reverberations and echoes (e.g. speech signals bouncing off room walls), and may include any of the complications to the mixing process mentioned above.

Mixed signals to be used for source separation can initially be time domain representations of the mixed observations (e.g. in the cocktail part problem mentioned above, they would be mixed audio signals as functions of time). ICA processes have been developed to perform the source separation on time-domain signals from convolutive mixed signals and can give good results; however, the separation of convolutive mixtures of time domain signals can be very computationally intensive, requiring lots of time and processing resources and thus prohibiting its effective utilization in many common real world ICA applications.

A much more computationally efficient algorithm can be implemented by extracting frequency data from the observed time domain signals. In doing this, the convolutive operation in the time domain is replaced by a more computationally efficient multiplication operation in the frequency domain. A Fourier-related transform, such as a short-time Fourier transform (STFT), can be performed on the time-domain data in order to generate frequency representations of the observed mixed signals and load frequency bins, whereby the STFT converts the time domain signals into the time-frequency domain. A STFT can generate a spectrogram for each time segment analyzed, providing information about the intensity of each frequency bin at each time instant in a given time segment.

Although the STFT is referred to herein as an example of a Fourier-related transform, the term "Fourier-related transform" is not so limited. In general, the term "Fourier-related transform" refers to a linear transform of functions related to Fourier analysis. Such transformations map a function to a set of coefficients of basis functions, which are typically sinusoidal and are therefore strongly localized in the frequency spectrum. Examples of Fourier-related transforms applied to continuous arguments include the Laplace transform, the two-sided Laplace transform, the Mellin transform, Fourier transforms including Fourier series and sine and cosine transforms, the short-time Fourier transform (STFT), the fractional Fourier transform, the Hartley transform, the Chirplet transform and the Hankel transform. Examples of Fourier-related transforms applied to discrete arguments include the discrete Fourier transform (DFT), the discrete time Fourier transform (DTFT), the discrete sine transform (DST), the discrete cosine transform (DCT), regressive discrete Fourier series, discrete Chebyshev transforms, the generalized discrete Fourier transform (GDFT), the Z-transform, the modified discrete cosine transform, the discrete Hartley transform, the discretized STFT, and the Hadamard transform (or Walsh function). The transformation of time domain signal to spectrum domain representation can also been done by means of wavelet analysis or functional analysis that is applied to single dimension time domain speech signal, we will still call the transformation as Fourier-related transform for the simplicity of the patent. Traditional approaches to frequency domain ICA involve performing the independent component analysis at each frequency bin (i.e. independence of the same frequency bin between different signals will be maximized). Unfortunately, this approach inherently suffers from a well-known permutation problem, which can cause estimated frequency bin data of the source signals to be grouped in incorrect sources. As such, when resulting time domain signals are reproduced from the frequency domain signals (such as by an inverse STFT), each estimated time domain signal that is produced from the separation process may contain frequency data from incorrect sources.

Various approaches to solving the misalignment of frequency bins in source separation by frequency domain ICA have been proposed. However, to date none of these approaches achieve high enough performance in real world noisy environments to make them an attractive solution for acoustic source separation applications.

Conventional approaches include performing frequency domain ICA at each frequency bin as described above and applying post-processing that involves correcting the alignment of frequency bins by various methods. However, these approaches can suffer from inaccuracies and poor performance in the correcting step. Additionally, because these processes require an additional processing step after the initial ICA separation, processing time and computing resources required to produce the estimated source signals are greatly increased.

Other approaches attempt to address the permutation problem more directly by performing the ICA at all frequency bins collectively. One such approach is disclosed in Hiroe, U.S. Pat. No. 7,797,153 (hereinafter Hiroe), the entire disclosure of which is herein incorporated by reference. Hiroe discloses a method in which the ICA calculations are performed on entire spectrograms as opposed to individual frequency bins, thereby attempting to prevent the permutation problem that occurs when ICA is performed at each frequency bin. Hiroe sets up a score function that uses a multivariate probability density function (PDF) to account for the relationship between frequency bins in the separation process.

However, because the approaches of Hiroe above model the relationship between frequency bins with a singular multivariate PDF, they fail to account for the different statistical properties of different sources as well as a change in the statistical properties of a source signal over time. As a result, they suffer from poor performance when attempting to analyze a wide time frame. Furthermore, the approaches are generally unable to effectively analyze multi-source speech signals (i.e. multiple speakers in the same location at the same time), because the underlying singular PDF is inadequate for both sources.

To date, known approaches to frequency domain ICA suffer from one or more of the following drawbacks: inability to accurately align frequency bins with the appropriate source, requirement of a post-processing that requires extra time and processing resources, poor performance (i.e. poor signal to noise ratio), inability to efficiently analyze multi-source speech, requirement of position information for microphones, and a requirement for a limited time frame to be analyzed.

For the foregoing reasons, there is a need for methods and apparatus that can efficiently implement frequency domain independent component analysis to produce estimated source signals from a set of mixed signals without the aforementioned drawbacks. It is within this context that a need for the present invention arises.

BRIEF DESCRIPTION OF THE DRAWINGS

The teachings of the present invention can be readily understood by considering the following detailed description in conjunction with the accompanying drawings, in which.

DETAILED DESCRIPTION

Figure 1A:
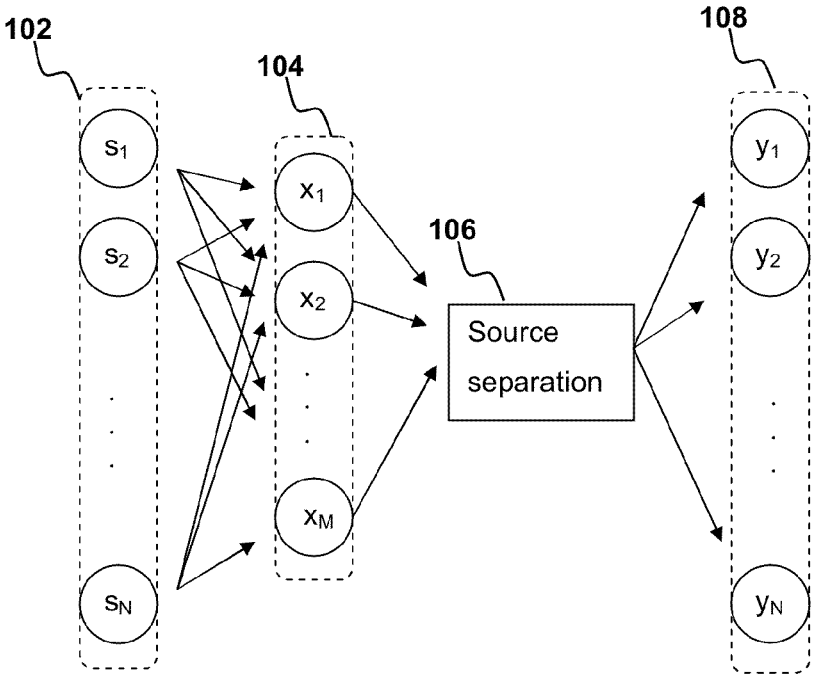
FIG. 1A is a schematic of a source separation process.

The following description will describe embodiments of the present invention primarily with respect to the processing of audio signals detected by a microphone array. More particularly, embodiments of the present invention will be described with respect to the separation of speech source signals or other audio source signals from mixed audio signals that are detected by a microphone array. However, it is to be understood that ICA has many far reaching applications in a wide variety of technologies, including optical signal processing, neural imaging, stock market prediction, telecommunication systems, facial recognition, and more. Mixed signals can be obtained from a variety of sources, preferably by being observed from array of sensors or transducers that are capable of observing the signals of interest into electronic form for processing by a communications device or other signal processing device. Accordingly, the accompanying claims are not to be limited to speech separation applications or microphone arrays except where explicitly recited in the claims.

In order to address the permutation problem described above, a separation process utilizing ICA can define relationships between frequency bins according to multivariate probability density functions. In this manner, the permutation problem can be substantially avoided by accounting for the relationship between frequency bins in the source separation process and thereby preventing misalignment of the frequency bins as described above.

The parameters for each multivariate PDF that appropriately estimates the relationship between frequency bins can depend not only on the source signal to which it corresponds, but also the time frame to be analyzed (i.e. the parameters of a PDF for a given source signal will depend on the time frame of that signal that is analyzed). As such, the parameters of a multivariate PDF that appropriately models the relationship between frequency bins can be considered to be both time dependent and source dependent. However, it is noted that the general form of the multivariate PDF can be the same for the same types of sources, regardless of which source or time segment that corresponds to the multivariate PDF. For example, all sources over all time segments can have multivariate PDFs with super-Gaussian form corresponding to speech signals, but the parameters for each source and time segment can be different. Known approaches to frequency domain ICA that utilize probability density functions to model the relationship between frequency bins fail to account for these different parameters by modeling a single multivariate PDF in the ICA calculation.

Embodiments of the present invention can account for the different statistical properties of different sources as well as the same source over different time segments by using weighted mixtures of component multivariate probability density functions having different parameters in the ICA calculation. The parameters of these mixtures of multivariate probability density functions, or mixed multivariate PDFs, can be weighted for different source signals, different time segments, or some combination thereof. In other words, the parameters of the component probability density functions in the mixed multivariate PDFs can correspond to the frequency components of different sources and/or different time segments to be analyzed.

Accordingly, embodiments of the present invention are able to analyze a much wider time frame with better performance than known processes as well as account for multiple speakers in the same location at the same time (i.e. multi-source speech).

In the description that follows, models corresponding to known ICA processes utilizing single multivariate PDFs in the ICA calculation will be first be explained to aid in the understanding of the present invention and to provide a proper set up for models that correspond to embodiments of the present invention. New models that use mixed multivariate PDFs according to embodiments of the present invention will then be explained.

Source Separation Problem Set Up

Referring to FIG. 1A, a basic schematic of a source separation process having N separate signal sources 102 is depicted. Signals from sources 102 can be represented by the column vector $s=[s_1, s_2, \ldots, s_N]^T$. It is noted that the superscript T simply indicates that the column vector s is simply the transpose of the row vector $[s_1, s_2, \ldots, s_N]$. Note that each source signal can be a function modeled as a continuously random variable (e.g. a speech signal as a function of time), but for now the function variables are omitted for simplicity. The sources 102 are observed by M separate sensors 104, producing M different mixed signals which can be represented by the vector $x=[x_1, x_2, \ldots, x_M]^T$. Source separation 106 separates the mixed signals $x=[x_1, x_2, \ldots, x_M]^T$ received from the sensors 104 to produce estimated source signals 108, which can be represented by the vector $y=[y_1, y_2, \ldots, y_N]^T$ and which correspond to the source signals from signal sources 102. Source separation as shown generally in FIG. 1A can produce the estimated source signals $y=[y_1, y_2, \ldots, y_N]^T$ that correspond to the original sources 102 without information of the mixing process that produces the mixed signals observed by the sensors $x=[x_1, x_2, \ldots, x_M]^T$.

Figure 1B:
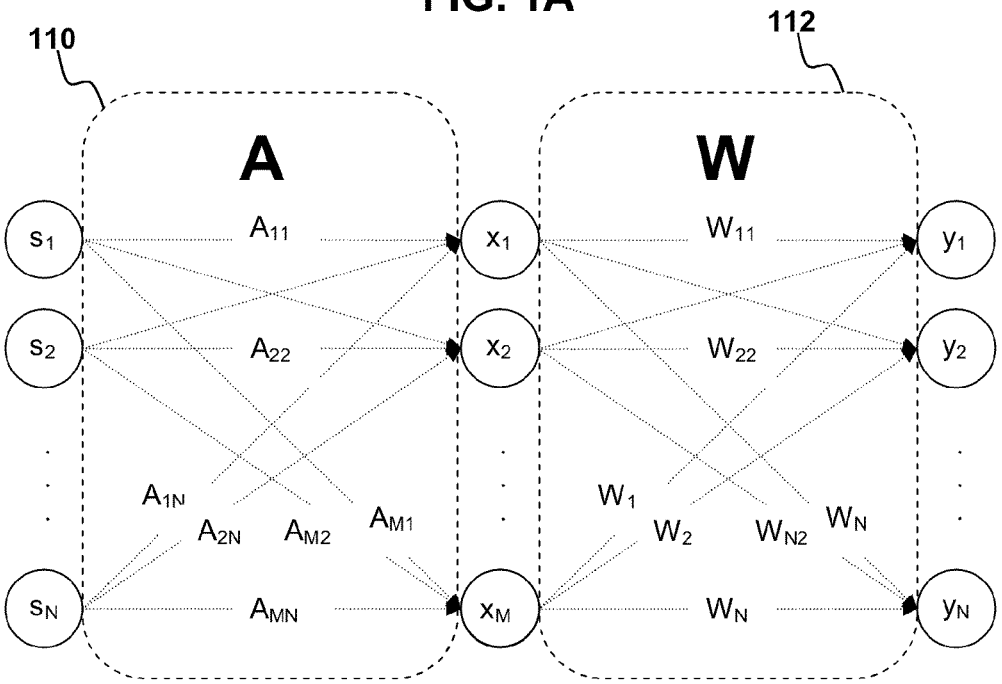
FIG. 1B is a schematic of a mixing and de-mixing model of a source separation process.

Referring to FIG. 1B, a basic schematic of a general ICA operation to perform source separation as shown in FIG. 1A is depicted. In a basic ICA process, the number of sources 102 is equal to the number of sensors 104, such that M=N and the number observed mixed signals is equal to the number of separate source signals to be reproduced. Before being observed by sensors 104, the source signals s emanating from sources 102 are subjected to unknown mixing 110 in the environment before being observed by the sensors 104. This mixing process 110 can be represented as a linear operation by a mixing matrix A as follows:

$$A = \begin{bmatrix} A_{11} & \ldots & A_{1N} \\ \vdots & \ddots & \vdots \\ A_{M1} & \ldots & A_{MN} \end{bmatrix} \tag{1}$$

Multiplying the mixing matrix A by the source signals vector s produces the mixed signals x that are observed by the sensors, such that each mixed signal $x_i$ is a linear combination of the components of the source vector s, and:

$$\begin{bmatrix} x_1 \\ \vdots \\ x_N \end{bmatrix} = \begin{bmatrix} A_{11} & \ldots & A_{1N} \\ \vdots & \ddots & \vdots \\ A_{M1} & \ldots & A_{MN} \end{bmatrix} \begin{bmatrix} s_1 \\ \vdots \\ s_N \end{bmatrix} \tag{2}$$

The goal of ICA is to determine a de-mixing matrix W of 112 that is the inverse of the mixing process, such that $W=A^{-1}$. The de-mixing matrix 112 can be applied to the mixed signals $x=[x_1, x_2, \ldots, x_M]^T$ to produce the estimated sources $y=[y_1, y_2, \ldots, y_N]^T$ up to the permuted and scaled output, such that, $$y=Wx=WAs\approx PDs \tag{3}$$

where P and D represent a permutation matrix and a scaling matrix, respectively, each of which has only diagonal components.

Flowchart Description

Figure 2:
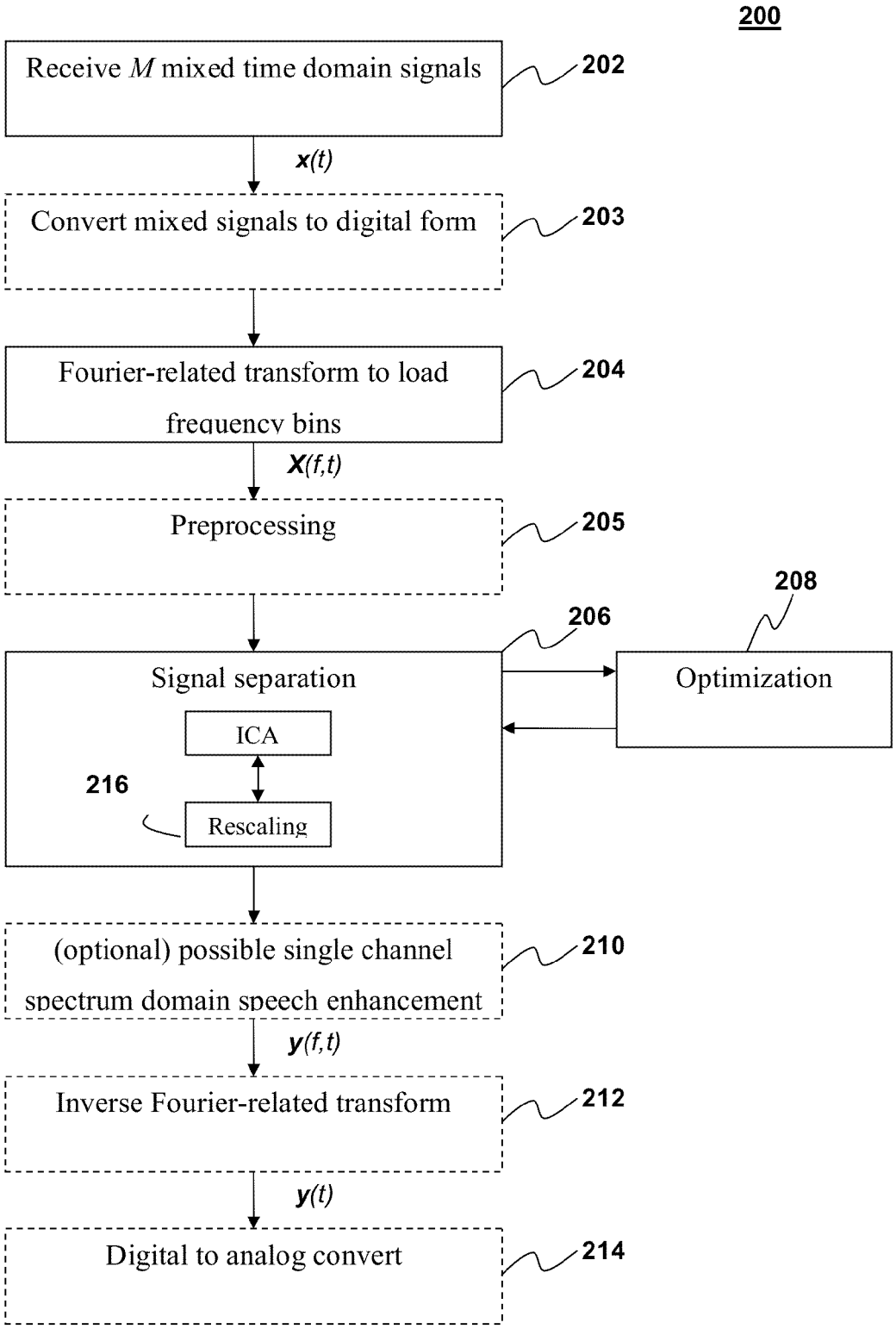
FIG. 2 is a flow diagram of an implementation of source separation utilizing ICA according to an embodiment of the present invention.

Referring now to FIG. 2, a flowchart of a method of signal processing 200 according to embodiments of the present invention is depicted. Signal processing 200 can include receiving M mixed signals 202. Receiving mixed signals 202 can be accomplished by observing signals of interest with an array of M sensors or transducers such as a microphone array having M microphones that convert observed audio signals into electronic form for processing by a signal processing device. The signal processing device can perform embodiments of the methods described herein and, by way of example, can be an electronic communications device such as a computer, handheld electronic device, videogame console, or electronic processing device. The microphone array can produce mixed signals $x_1(t), \ldots, x_M(t)$ that can be represented by the time domain mixed signal vector x(t). Each component of the mixed signal vector $x_m(t)$ can include a convolutive mixture of audio source signals to be separated, with the convolutive mixing process cause by echoes, reverberation, time delays, etc.

If signal processing 200 is to be performed digitally, signal processing 200 can include converting the mixed signals x(t) to digital form with an analog to digital converter (ADC). The analog to digital conversion 203 will utilize a sampling rate sufficiently high to enable processing of the highest frequency component of interest in the underlying source signal. Analog to digital conversion 203 can involve defining a sampling window that defines the length of time segments for signals to be input into the ICA separation process. By way of example, a rolling sampling window can be used to generate a series of time segments converted into the time-frequency domain. The sampling window can be chosen according to various application specific requirements, as well as available resources, processing power, etc.

In order to perform frequency domain independent component analysis according to embodiments of the present invention, a Fourier-related transform 204, preferably STFT, can be performed on the time domain signals to convert them to time-frequency representations for processing by signal processing 200. STFT will load frequency bins 204 for each time segment and mixed signal on which frequency domain ICA will be performed. Loaded frequency bins can correspond to spectrogram representations of each time-frequency domain mixed signal for each time segment.

In order to simplify the mathematical operations to be performed in frequency domain ICA, in embodiments of the present invention, signal processing 200 can include preprocessing 205 of the time frequency domain signal X(f, t), which can include well known preprocessing operations such as centering, whitening, etc. Preprocessing can include decorrelating the mixed signals by principal component analysis (PCA) prior to performing the source separation 206.

Signal separation 206 by frequency domain ICA can be performed iteratively in conjunction with optimization 208. Source separation 206 involves setting up a de-mixing matrix operation W that produces maximally independent estimated source signals Y of original source signals S when the de-mixing matrix is applied to mixed signals X corresponding to those received by 202. Source separation 206 incorporates optimization process 208 to iteratively update the de-mixing matrix involved in source separation 206 until the de-mixing matrix converges to a solution that produces maximally independent estimates of source signals. Optimization 208 incorporates an optimization algorithm or learning rule that defines the iterative process until the de-mixing matrix converges. By way of example, signal separation 206 in conjunction with optimization 208 can use an expectation maximization algorithm (EM algorithm) to estimate the parameters of the component probability density functions.

In some implementations, the cost function may be defined using an estimation method, such as Maximum a Posteriori (MAP) or Maximum Likelihood (ML). The solution to the signal separation problem can them be found using a method such as EM, a Gradient method, and the like. By way of example, and not by way of limitation, the cost function of independence may be defined using ML and optimized using EM. Once estimates of source signals are produced by separation process (e.g. after the de-mixing matrix converges), rescaling and possibly additional single channel spectrum domain speech enhancement (post processing) 210 can be performed to produce accurate time-frequency representations of estimated source signals required due to simplifying pre-processing step 205.

In order to produce estimated sources signals y(t) in the time domain that directly correspond to the original time domain source signals s(t), signal processing 200 can further include performing an inverse Fourier transform 212 (e.g. inverse STFT) on the time-frequency domain estimated source signals Y(f, t) to produce time domain estimated source signals y(t). Estimated time domain source signals can be reproduced or utilized in various applications after digital to analog conversion 214. By way of example, estimated time domain source signals can be reproduced by speakers, headphones, etc. after digital to analog conversion, or can be stored digitally in a non-transitory computer readable medium for other uses. The Fourier transform process 212 and digital to analog conversion process are optional and need not be implemented, e.g., if the spectrum output of the rescaling 216 and optional single channel spectrum domain speech enhancement 210 is converted directly to a speech recognition feature.

Models

Signal processing 200 utilizing source separation 206 and optimization 208 by frequency domain ICA as described above can involve appropriate models for the arithmetic operations to be performed by a signal processing device according to embodiments of the present invention. In the following description, first old models will be described that utilize multivariate PDFs in frequency domain ICA operations, but do not utilize mixed multivariate PDFs. New models will then be described that utilize mixed multivariate PDFs according to embodiments of the present invention. While the models described herein are provided for complete and clear disclosure of embodiments of the present invention, persons having ordinary skill in the art can conceive of various alterations of the following models without departing from the scope of the present invention.

Model Using Multivariate PDFs

A model for performing source separation 206 and optimization 208 using frequency domain ICA as shown in FIG. 2 will first be described according to known approaches that utilize singular multivariate PDFs.

In order to perform frequency domain ICA, frequency domain data must be extracted from the time domain mixed signals, and this can be accomplished by performing a Fourier-related transform on the mixed signal data. For example, a short-time Fourier transform (STFT) can convert the time domain signals x(t) into time-frequency domain signals, such that, $$X_m(f,t)=STFT(x_m(t)) \tag{4}$$

and for F number of frequency bins, the spectrum of the $m^{th}$ microphone will be, $$X_m(t)=[X_m(1,t)\ldots X_m(F,t)] \tag{5}$$

For M number of microphones, the mixed signal data can be denoted by the vector X(t), such that, $$X(t)=[X_1(t)\ldots X_M(t)]^T \tag{6}$$

In the expression above, each component of the vector corresponds to the spectrum of the m-th microphone over all frequency bins 1 through F. Likewise, for the estimated source signals Y(t), $$Y_m(t)=[Y_m(1,t)\ldots Y_m(F,t)] \tag{7}$$

$$Y(t)=[Y_1(t)\ldots Y_M(t)]^T \tag{8}$$

Accordingly, the goal of ICA can be to set up a matrix operation that produces estimated source signals Y(t) from the mixed signals X(t), where W(t) is the de-mixing matrix. The matrix operation can be expressed as, $$Y(t)=W(t)X(t) \tag{9}$$

Where W(t) can be set up to separate entire spectrograms, such that each element $W_{ij}(t)$ of the matrix W(t) is developed for all frequency bins as follows, $$W_{ij}(t)=\begin{bmatrix} W_{ij}(1,t) & \ldots & 0 \\ \vdots & \ddots & \vdots \\ 0 & \ldots & W_{ij}(F,t) \end{bmatrix} \tag{10}$$

$$W(t)\triangleq\begin{bmatrix} W_{11}(t) & \ldots & W_{1M}(t) \\ \vdots & \ddots & \vdots \\ W_{M1}(t) & \ldots & W_{MM}(t) \end{bmatrix} \tag{11}$$

For now, it is assumed that there are the same number of sources as there are microphones (i.e. number of sources=M). Embodiments of the present invention can utilize ICA models for underdetermined cases, where the number of sources is greater than the number of microphones, but for now explanation is limited to the case where the number of sources is equal to the number of microphones for clarity and simplicity of explanation.

It is noted that embodiments of the present invention may also be applied to overestimated cases, e.g., cases in which there are more microphones than sources. It is noted that if one were to use a singular multivariate PDF, determined and overdetermined cases can be solved, and underdetermined cases generally cannot be solved. But, if one were to use mixed a multivariate PDF, it can be applied to every case including determined, underdetermined and overdetermined cases.

The de-mixing matrix W(t) can be solved by a looped process that involves providing an initial estimate for de-mixing matrix W(t) and iteratively updating the de-mixing matrix until it converges to a solution that provides maximally independent estimated source signals Y. The iterative optimization process involves an optimization algorithm or learning rule that defines the iteration to be performed until convergence (i.e. until the de-mixing matrix converges to a solution that produces maximally independent estimated source signals).

Optimization can involve a cost function and can be defined to minimize mutual information for the estimated sources. The cost function can utilize the Kullback-Leibler Divergence as a natural measure of independence between the sources, which measures the difference between the joint probability density function and the marginal probability density function for each source. Using spherical distribution as one kind of PDF, the PDF $P_{Y_m}(Y_m(t))$ of the spectrum of m-th source can be, $$P_{Y_m}(Y_m(t)) = h \cdot \psi(\|Y_m(t)\|_2) \tag{12}$$

$$\|Y_m(t)\|_2 \triangleq \left(\sum_f |Y_m(f,t)|^2\right)^{\frac{1}{2}} \tag{13}$$

Where $\psi(x)=\exp\{-\Omega|x|\}$, $\Omega$ is a proper constant and h is the normalization factor in the above expression. The final multivariate PDF for the m-th source is thus, $$P_{Y_m}(Y_m(t)) = h \cdot \psi(\|Y_m(t)\|_2) = h\exp\{-\Omega\|Y_m(t)\|_2\} = h\exp\left\{-\Omega\left(\sum_f |Y_m(f,t)|^2\right)^{\frac{1}{2}}\right\} \tag{14}$$

The cost function can be defined that utilizes the PDF mentioned in the above expression as follows, $$KLD(Y) \triangleq \sum_m -\mathbb{E}_t(\log(P_{Y_m}(Y_m(t)))) - \log|\det(W)| - H(X) \tag{15}$$

Where $\mathbb{E}_t$ in the above expression is the mean expectation over frames and H is the entropy.

The model described above attempts to address the permutation problem with the cost function that utilizes the multivariate PDF to model the relationship between frequency bins. The permutation problem is described in Equation (3) as the permutation matrix P. Solving for the de-mixing matrix involves minimizing the cost function above, which will minimize mutual information to produce maximally independent estimated source signals. However, only a single multivariate PDF is utilized in the cost function, suffering from the drawbacks described above.

New Model Using Mixed Multivariate PDFs

Having modeled known approaches that utilize singular multivariate PDFs in frequency domain ICA, a new model using mixed multivariate PDFs according to embodiments of the present invention will be described.

According to embodiments of the present invention, a speech separation system can utilize independent component analysis involving mixed multivariate probability density functions that are mixtures of L component multivariate probability density functions having different parameters. It is noted that the separate source signals can be expected to have PDFs with the same general form (e.g. separate speech signals can be expected to have PDFs of super-Gaussian form), but the parameters from the different source signals can be expected to be different. Additionally, because the signal from a particular source will change over time, the parameters of the PDF for a signal from the same source can be expected to have different parameters at different time segments. Accordingly, embodiments of the present invention utilize mixed multivariate PDFs that are mixtures of PDFs weighted for different sources and/or different time segments. Accordingly, embodiments of the present invention can utilize a mixed multivariate PDF that can accounts for the different statistical properties of different source signals as well as the change of statistical properties of a signal over time.

As such, for a mixture of L different component multivariate PDFs, L can generally be understood to be the product of the number of time segments and the number of sources for which the mixed PDF is weighted (e.g. L=number of sources×number of time segments).

Embodiments of the present invention can utilize pre-trained eigenvectors to estimate of the de-mixing matrix. Where V(t) represents pre-trained eigenvectors and E(t) is the eigenvalues, de-mixing can be represented by, $$Y(t)=V(t)E(t)=W(t)X(t) \tag{16}$$

V(t) can be pre-trained eigenvectors of clean speech, music, and noises (i.e. V(t) can be pre-trained for the types of original sources to be separated). Optimization can be performed to find both E(t) and W(t). When it is chosen that $V(t)\equiv I$ then estimated sources equal the eigenvalues such that Y(t)=E(t).

Optimization according to embodiments of the present invention can involve utilizing an expectation maximization algorithm (EM algorithm) to estimate the parameters of the mixed multivariate PDF for the ICA calculation.

According to embodiments of the present invention, the probability density function $P_{Y_{m,l}}(Y_{m,l}(t))$ is assumed to be a mixed multivariate PDF that is a mixture of multivariate component PDFs. Where the old mixing system is represented by X(f,t)=A(f)S(f,t), the new mixing system becomes, $$X(f,t) = \sum_{l=0}^{L} A(f,l)S(f,t-l) \tag{17}$$

Likewise, where the old de-mixing system is represented by Y(f,t)=W(f)X(f,t) the new de-mixing system becomes, $$Y(f,t)=\Sigma_{l=0}^{L} W(f,l)X(f,t-l)=\Sigma_{l=0}^{L} Y_{m,l}(f,t) \tag{18}$$

Where A(f, l) is a time dependent mixing condition and can also represent a long reverberant mixing condition. Where spherical distribution is chosen for the PDF, the new mixed multivariate PDF becomes, $$P_{Y_m}(Y_{m,l}(t)) \triangleq \Sigma_l^L b_l(t) P_{Y_{m,l}}(Y_m(t)), t \propto [t1, t2] \tag{19}$$

$$P_{Y_m}(Y_m(t)) = \Sigma_l b_l(t) h_l f_l(\|Y_m(t)\|_2), t \propto [t1, t2] \tag{20}$$

Where multivariate generalized Gaussian is chosen for the PDF, the new mixed multivariate PDF becomes, $$P_{Y_{m,l}}(Y_{m,l}(t)) \triangleq \Sigma_l^L b_l(t) h_1 \Sigma_c \rho(c_l(m,t)) \Pi_f N_c(Y_m(f,t) | 0, v_{Y_m(f,t)}^{f}), t \propto [t1, t2] \tag{21}$$

Where ρ(c) is the weight between different c-th component multivariate generalized Gaussian and $b_l(t)$ is the weight between different time segments. $N_c(Y_m(f, t)|0, v_{Y_m(f,t)}^{f})$ can be pre-trained with offline data, and further trained with run-time data.

The iteration solution of W for $P_{Y_m}(Y_{m,l}(t))$ of 'spherical distribution':

To simplify the notation, one can omit 't' for frequency domain representation from equation 22 to equation 24. For example, we use instead $Y_n$ of $Y_n(t)$. The mutual information I, using the KL divergence, can be defined as, $$I \triangleq KLD\left(p(Y_1 \ldots, Y_M) \middle\| \prod_{i=1}^{M} p(Y_i)\right) = \int p(Y_1 \ldots, Y_M) \log \frac{p(Y_1 \ldots, Y_M)}{\prod_{i=1}^{N} p(Y_i)} dY_1 \ldots dY_M = \int p(X_1 \ldots X_M) \log p(X_1 \ldots X_M) dX_1 \ldots dX_M - \sum_{k=1}^{K} \log|\det W^{(k)}| - \sum_{i=1}^{M} \log p(Y_i) \tag{22}$$

The final learning rule by using natural gradient method becomes as followings $$\frac{\partial I}{\partial W^{(k)}} (W^{(k)})^T W^{(k)} \triangleq \Delta W^{(k)} \propto \left\{\left[(W^{(k)})^T\right]^{-1} - \phi(Y^{(k)})(x^{(k)})^T\right\}(W^{(k)})^T W^{(k)} = \left[I - \phi(Y^{(k)})(Y^{(k)})^T\right] W^{(k)} \tag{23}$$

where I is an identity matrix $(N \times N)$ and $\phi(Y^{(k)}) = -\frac{\partial \log p(Y^{(k)})}{\partial y_i^{(k)}}$ In every iteration of the learning process, we update the demixing filters using gradient descent method as follows, $$W^{(k)} = W^{(k)} + \eta \Delta W^{(k)}$$

where η is the learning rate.

The iteration solution of W for $P_{Y_m(f,t)}(Y_m(f, t))$ of 'multivariate Gaussian distribution':

The likelihood function that is defined by mutual information becomes as follows $$L' = KLD\left(p(Y_1 \ldots, Y_M) \middle\| \prod_{i=1}^{M} p(Y_i)\right) =$$

-continued $$\int p(Y_1 \ldots, Y_M) \log \frac{p(Y_1 \ldots, Y_M)}{\prod_{m=1}^{M} p(Y_m)} dY_1 \ldots dY_M = \int p(X_1 \ldots X_M) \log p(X_1 \ldots X_M) dX_1 \ldots dX_M - \sum_{k=1}^{K} \log|\det W^{(k)}| - \sum_{i=1}^{M} \log p(Y_m)$$

By Jensen's inequality, one can obtain the following equation and omit the first term because $\int p(X_1 \ldots X_M) \log p(X_1 \ldots X_m) dX_1 \ldots dX_M$ is the entropy of microphone signal and constant.

$$L' \geq \sum_{k=1}^{K} \log|\det W^{(k)}| - \sum_{l=1}^{L} \sum_{m=1}^{M} \gamma(\theta_{m,l}) \log \frac{p(Y_m, Q = l | \theta_{m,l})}{\gamma(\theta_{m,l})} = L$$

where $p(Y_i, Q=l|\theta_{m,l})$ is the conditional probability function given by the hidden variable set $\theta_{m,l}$, $\Sigma_{l=1}^{L} \gamma(\theta_{m,l}) = 1$ for all m, and we define the equations as L.

We define the marginal PDF as a mixture of multivariate Gaussian distribution (MMGD) having zero mean as follows $$P_{Y_m}(Y_m, Q = l | \theta_m) = \sum_{i=1}^{L} \alpha_i \left(\sum_{j=1}^{N} \beta_{i,j} N\left(Y_{m,i,j} | 0, v_{Y_{m,i,j}(f,t)}\right)\right) = \sum_{i=1}^{L} \alpha_i P_{Y_{m,i}}(Y_{m,i} | \theta_i)$$

where $\alpha_i$ is the weight between different speech time segments

For simplification, we define $\Sigma_{j=1}^{N} \beta_{i,j} N(Y_{m,i,j}|0, v_{Y_{m,i,j}(f,t)})$ as $P_{Y_{m,i}}(Y_{m,i}|\theta_i)$ $$P_{Y_{m,i}}(Y_{m,i} | \theta_i) = \sum_{j=1}^{N} \beta_{i,j} Ps_{m,i,j}(Y_{m,i,j} | \theta_{i,j}) = \sum_{j=1}^{N} \beta_{i,j} N\left(Y_{m,i,j} | 0, v_{Y_{m,i,j}}\right)$$

where $\beta_{i,j}$ is the weight among the different multivariate generalized Gaussian One can use the EM algorithm to update the parameters that iteratively maximize L(θ) over $\gamma(\theta_{m,l})$ in an E-step and an M-step until convergence.

In the E-step, $\gamma(\theta_{m,l})$ is maximized such that $$\gamma(\theta_{m,i}) = \frac{p(Y_m, Q = l | \theta_{m,l}) \pi_{m,l}}{\xi_{m,l}}$$

where $\xi_{m,l}$ can be determined as the value needed to ensure that $\Sigma_{l=1}^{L} \gamma(\theta_{m,l}) = 1$ for all m $$p(Y_m, Q = l | \theta_{m,l}) = \sum_{i=1}^{L} \alpha_i \left(\sum_{j=1}^{N} \beta_{i,j} N\left(Y_{m,i,j} | 0, v_{Y_{m,i,j}}\right)\right)$$

In the M-Step, $$v_{Y_{m,i,j}} = \frac{E\left(N\left(Y_{m,i,j} \mid 0, v_{Y_{m,i,j}}\right) Y_{m,i,j} Y_{m,i,j}^H\right)}{E\left(N\left(Y_{m,i,j} \mid 0, v_{Y_{m,i,j}}\right)\right)} \tag{24}$$

$$\beta_{i,j} = E\left(\left(\sum_{j=1}^{N} \beta_{i,j} N\left(Y_{m,i,j} \mid 0, v_{Y_{m,i,j}}\right)\right)\right)$$

$$\alpha_i = E\left(N\left(Y_{m,i,j} \mid 0, v_{Y_{m,i,j}}\right)\right)$$

$$\pi_{m,l} = \frac{\sum_{m=1}^{M} \gamma(\theta_{m,l})}{E\left(\sum_{l=1}^{L} \gamma(\theta_{m,l})\right)}$$

The closed form solution of W with pre-trained Eigen-vectors may be implemented as follows:

Y(t)=V(t)E(t)=W(t)X(t), where V(t) can be pre-trained eigen-vectors of clean speech, music, and noises. E(t) is the eigen-values.→

$$\begin{cases} V(t)\acute{E}(t) = Y(t) = \acute{W}(t)X(t),\ t = [t_1, t_2] \rightarrow \text{data set 1} \\ V(t)E(t) = Y(t) = W(t)X(t),\ t = [t_3, t_4] \rightarrow \text{data set 2} \end{cases}$$

$V(t)$ is pre-trained

Dimension of can be E(t) or É(t) is smaller than X(t)

The optimization is to find {V(t), E(t), W(t)}. Data set 1 is of training data or calibration data. Data set 2 is of testing data or real time data. When we choose V(t)≡I, then Y(t)=E(t), the formula falls back into normal case of single equation.

a) When data set 1 is of mono-channel clean training data, Y(t) is known, Ẃ(t)=I, X(t)=Y(t). The optimal solution V(t) is the Eigen vectors of Y(t).

b) For eq#2.4, the task is to find best {E(t), W(t)} given microphone array data X(t), and known Eigen vectors V(t). That is to solve the following equation $$V(t)E(t)=W(t)X(t)$$

If V(t) is a square matrix, $$E(t)=V(t)^{-1}W(t)X(t)$$

If V(t) is not a square matrix, $$E(t)=(v(t)^T V(t))^{-1} V(t)^T W(t)X(t)$$

or $$E(t)=v(t)^T (V(t)_T V(t))^{-1} W(t)X(t)$$

$P_{E_{m,l}}(E_{m,l}(t))$ is assumed to be a mixture of multivariate PDF for microphone 'm' and PDF mix mixture component 'l'.

b) New Demixing System $$E(f,t)=V^{-1}(f,t)W(f)X(f,t)$$

$$E(f,t)=\Sigma_{l=0}^{L} V^{-1}(f,t)W(f,l)X(f,t-l)=\Sigma_{l=0}^{L} E_{m,l}(f,t) \tag{25}$$

Note that a model for underdetermined cases (i.e. where the number of sources is greater than the number of microphones) can be derived from expressions (22) through (26) above and are within the scope of the present invention.

The ICA model used in embodiments of the present invention can utilize the cepstrum of each mixed signal, where $X_m(f, t)$ can be the cepstrum of $x_m(t)$ plus the log value (or normal value) of pitch, as follows, $$X_m(f,t)=sTFT(\log(\|x_m(t)\|^2)),\ f=1, 2, \ldots, F-1 \tag{26}$$

$$X_m(F,t) \triangleq \log(f_0(t)) \tag{27}$$

$$X_m(t)=[X_m(1,t) \ldots X_{F=1}(F-1,t)X_F(F,t)] \tag{28}$$

It is noted that a cepstrum of a time domain speech signal may be defined as the Fourier transform of the log(with unwrapped phase) of the Fourier transform of the time domain signal. The cepstrum of a time domain signal S(t) may be represented mathematically as FT(log(FT(S(t)))+ j2πq), where q is the integer required to properly unwrap the angle or imaginary part of the complex log function. Algorithmically, the cepstrum may be generated by performing a Fourier transform on a signal, taking a logarithm of the resulting transform, unwrapping the phase of the transform, and taking a Fourier transform of the transform. This sequence of operations may be expressed as: signal→FT→log→phase unwrapping→FT →cepstrum.

In order to produce estimated source signals in the time domain, after finding the solution for Y(t), pitch+cepstrum simply needs to be converted to a spectrum, and from a spectrum to the time domain in order to produce the estimated source signals in the time domain. The rest of the optimization remains the same as discussed above.

Different forms of PDFs can be chosen depending on various application specific requirements for the models used in source separation according to embodiments of the present invention. By way of example, the form of PDF chosen can be spherical. More specifically, the form can be super-Gaussian, Laplacian, or Gaussian, depending on various application specific requirements. It is noted that each mixed multivariate PDF is a mixture of component PDFs, and each component PDF in the mixture can have the same form but different parameters.

Figure 3A:
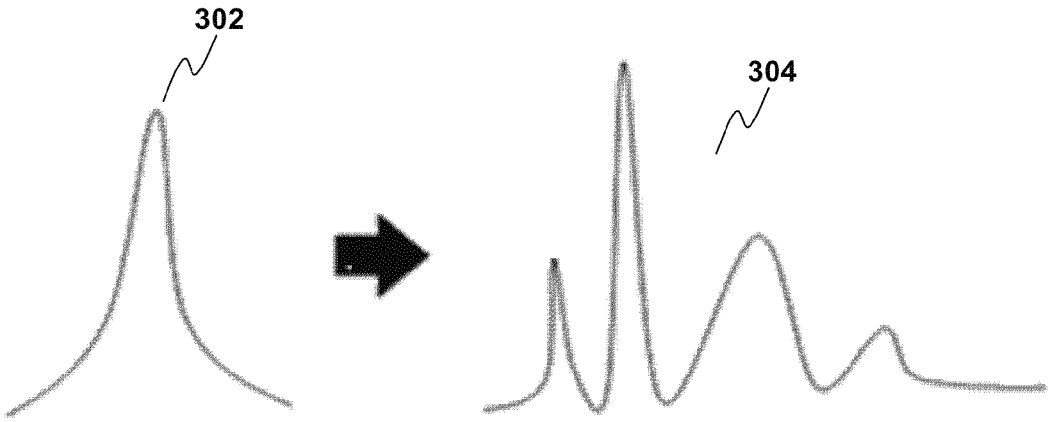
FIG. 3A is a drawing demonstrating the difference between a singular probability density function and a mixed probability density function.
Figure 3B:
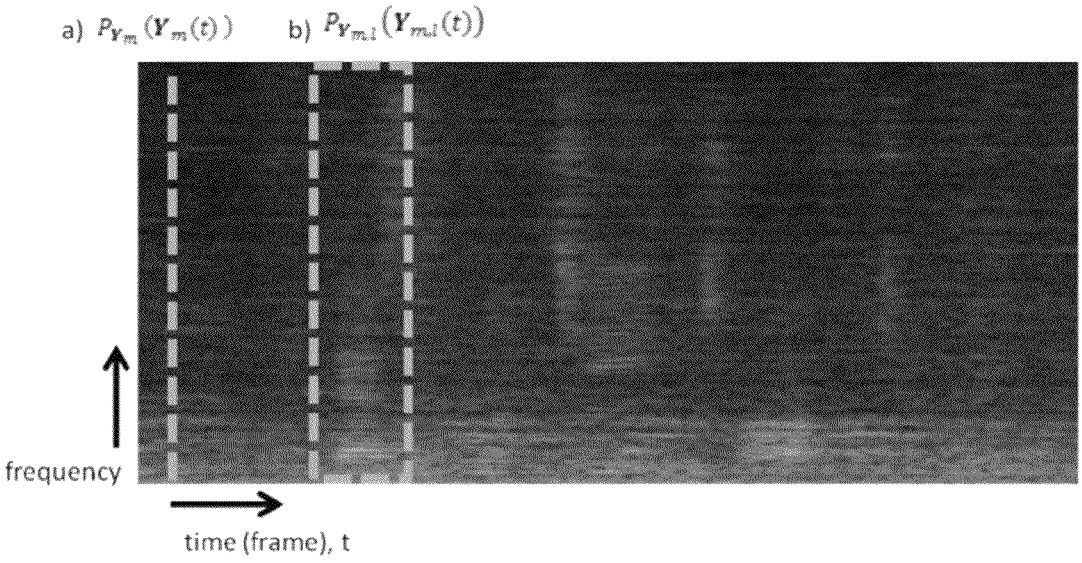
FIG. 3B is a spectrum plot illustrating the effect of a singular probability density function and a mixed multivariate probability density function on a spectrum drawing of a speech signal.

A mixed multivariate PDF may result in a probability density function having a plurality of modes corresponding to each component PDF as shown in FIG. 3A. In the singular PDF 302 in FIG. 3A, the probability density as a function of a given variable is uni-modal, i.e., a graph of the PDF 302 with respect to a given variable has only one peak. In the mixed PDF 304 the probability density as a function of a given variable is multi-modal, i.e., the graph of the mixed PDF 304 with respect to a given variable has more than one peak. It is noted that FIG. 3A is provided as a demonstration of the difference between a singular PDF 302 and a mixed PDF 304. Note, however, that the PDFs depicted in FIG. 3A are univariate PDFs and are merely provided to demonstrate the difference between a singular PDF and a mixed PDF. In mixed multivariate PDFs there would be more than one variable and the PDF would be multi-modal with respect to one or more of those variables. In other words, there could be more than one peak in a graph of the PDF with respect to at least one of the variables. FIG. 3B illustrates another way of envisioning the difference between a singular multivariate PDF and a mixed multivariate PDF is shown in the spectral plot depicted in. In FIG. 3B, singular multivariate PDF a) denoted $P_{Y_m}(Y_m(t))$ and a mixed multivariate PDF b) denoted $P_{Y_{m,l}}(Y_{m,l}(t))$. In this example, the singular multivariate PDF covers a single time instance and the mixed multivariate PDF covers a range of time instances.

Rescaling Process (FIG. 2, 216)

The rescaling process indicated at 216 of FIG. 2 adjusts the scaling matrix D, which is described in equation (3), among the frequency bins of the spectrograms. Furthermore, rescaling process 216 cancels the effect of the pre-processing.

By way of example, and not by way of limitation, the rescaling process indicated at 216 in may be implemented using any of the techniques described in U.S. Pat. No. 7,797,153 (which is incorporated herein by reference) at col. 18, line 31 to col. 19, line 67, which are briefly discussed below.

According to a first technique each of the estimated source signals $Y_k(f,t)$ may be re-scaled by producing a signal having the single Input Multiple Output from the estimated source signals $Y_k(f,t)$ (whose scales are not uniform). This type of re-scaling may be accomplished by operating on the estimated source signals with an inverse of a product of the de-mixing matrix W(f) and a pre-processing matrix Q(f) to produce scaled outputs $X_{yk}(f,t)$ given by:

$$X_{yk}(f,t) = (W(f)Q(f))^{-1}\begin{bmatrix} 0 \\ \vdots \\ Y_k(f,t) \\ \vdots \\ 0 \end{bmatrix} \tag{29}$$

where $X_{yk}(f, t)$ represents a signal at $y^{th}$ output from the $k^{th}$ source. Q(f) represents the pre-processing matrix, which may be implemented as part of the pre-processing indicated at 205 of FIG. 2. The pre-processing matrix Q(f) may be configured to make mixed input signals X(f,t) have zero mean and unit variance at each frequency bin.

Q(f) can be any function to give the decorrelated output. By way of example, and not by way of limitation, one can use a decorrelation process, e.g., as shown in equations below.

One can calculate the pre-processing matrix Q(f) as follows:

$$R(f)=E(X(f,t)X(f,t)^H) \tag{30}$$

$$R(f)q_n(f)=\lambda_n(f)q_n(f) \tag{31}$$

where $q_n(f)$ are the eigen vectors and $\lambda_n(f)$ are the eigen values.

$$Q'(f)=[q_1(f)\ldots q_N(f)] \tag{32}$$

$$Q(f)=\mathrm{diag}(\lambda_1(f)^{-1/2},\ldots,\lambda_N(f)^{-1/2})Q'(f)^H \tag{33}$$

In a second re-scaling technique, based on the minimum distortion principle, the de-mixing matrix W(f) may be recalculated according to $$W(f)\leftarrow\mathrm{diag}(W(f)Q(f)^{-1})W(f)Q(f) \tag{34}$$

In equation (34), Q (f) again represents the pre-processing matrix used to pre-process the input signals X(f,t) at 205 of FIG. 2 such that they have zero mean and unit variance at each frequency bin. $Q(f)^{-1}$ represents the inverse of the pre-processing matrix Q(f). The recalculated de-mixing matrix W(f) may then be applied to the original input signals X(f,t) to produce re-scaled estimated source signals $Y_k(f,t)$.

A third technique utilizes independency of an estimated source signal $Y_k(f,t)$ and a residual signal. A re-scaled estimated source signal may be obtained by multiplying the source signal $Y_k(f,t)$ by a suitable scaling coefficient $\alpha_k(f)$ for the $k^{th}$ source and $f_{th}$ frequency bin. The residual signal is the difference between the original mixed signal $X_k(ft)$ and the re-scaled source signal. If $\alpha_k$ (f) has the correct value, the factor $Y_k(f,t)$ disappears completely from the residual and the product $\alpha_k(f)\cdot Y_k(f,t)$ represents the original observed signal. The scaling coefficient may be obtained by solving the following equation:

$$E[f(X_k(f,t)-\alpha_k(f)Y_k(f,t)\overline{g(Y_k(f,t))})]-E[f(X_k(f,t)-\alpha_k(f)Y_k(f,t)]E[\overline{g(Y_k(f,t))}]=0 \tag{35}$$

In equation (35), the functions f(.) and g(.) are arbitrary scalar functions. The overlying line represents a conjugate complex operation and E[ ] represents computation of the expectation value of the expression inside the square brackets.

Signal Processing Device Description

In order to perform source separation according to embodiments of the present invention as described above, a signal processing device may be configured to perform the arithmetic operations required to implement embodiments of the present invention. The signal processing device can be any of a wide variety of communications devices. For example, a signal processing device according to embodiments of the present invention can be a computer, personal computer, laptop, handheld electronic device, cell phone, videogame console, etc.

Figure 4:
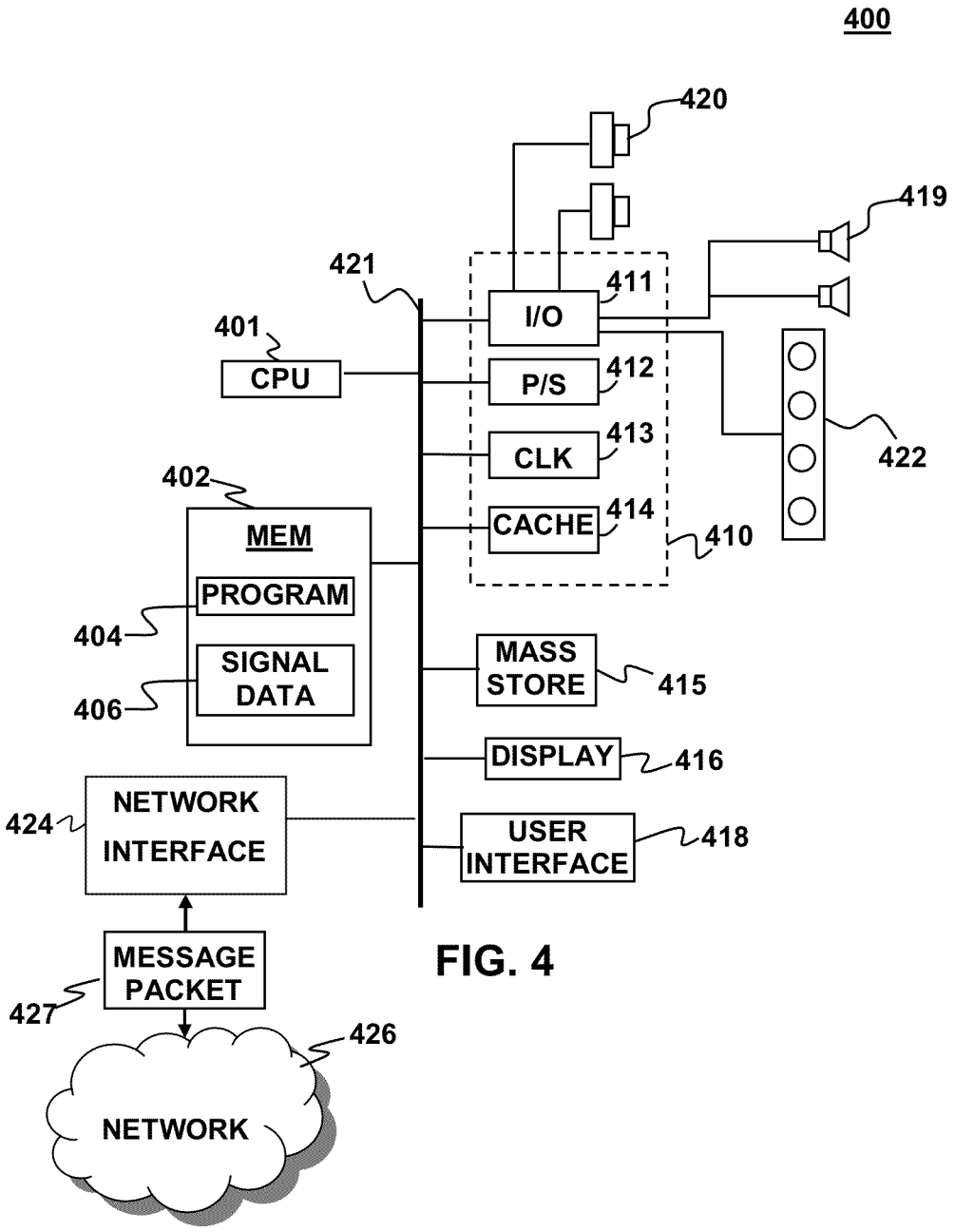
FIG. 4 is a block diagram of a source separation apparatus according to an embodiment of the present invention.

Referring to FIG. 4, an example of a signal processing device 400 capable of performing source separation according to embodiments of the present invention is depicted. The apparatus 400 may include a processor 401 and a memory 402 (e.g., RAM, DRAM, ROM, and the like). In addition, the signal processing apparatus 400 may have multiple processors 401 if parallel processing is to be implemented. Furthermore, signal processing apparatus 400 may utilize a multi-core processor, for example a dual-core processor, quad-core processor, or other multi-core processor. The memory 402 includes data and code configured to perform source separation as described above. Specifically, the memory 402 may include signal data 406 which may include a digital representation of the input signals x (after analog to digital conversion as shown in FIG. 2), and code for implementing source separation using mixed multivariate PDFs as described above to estimate source signals contained in the digital representations of mixed signals x.

The apparatus 400 may also include well-known support functions 410, such as input/output (I/O) elements 411, power supplies (P/S) 412, a clock (CLK) 413 and cache 414. The apparatus 400 may include a mass storage device 415 such as a disk drive, CD-ROM drive, tape drive, or the like to store programs and/or data. The apparatus 400 may also include a display unit 416 and user interface unit 418 to facilitate interaction between the apparatus 400 and a user. The display unit 416 may be in the form of a cathode ray tube (CRT) or flat panel screen that displays text, numerals, graphical symbols or images. The user interface 418 may include a keyboard, mouse, joystick, light pen or other device. In addition, the user interface 418 may include a microphone, video camera or other signal transducing device to provide for direct capture of a signal to be analyzed. The processor 401, memory 402 and other components of the system 400 may exchange signals (e.g., code instructions and data) with each other via a system bus 421 as shown in FIG. 4.

A microphone array 422 may be coupled to the apparatus 400 through the I/O functions 411. The microphone array may include 2 or more microphones. The microphone array may preferably include at least as many microphones as there are original sources to be separated; however, microphone array may include fewer or more microphones than the number of sources for underdetermined cases as noted above. Each microphone the microphone array 422 may include an acoustic transducer that converts acoustic signals into electrical signals. The apparatus 400 may be configured to convert analog electrical signals from the microphones into the digital signal data 406.

The apparatus 400 may include a network interface 424 to facilitate communication via an electronic communications network 426. The network interface 424 may be configured to implement wired or wireless communication over local area networks and wide area networks such as the Internet. The apparatus 400 may send and receive data and/or requests for files via one or more message packets 427 over the network 426. The microphone array 422 may also be connected to a peripheral such as a game controller instead of being directly coupled via the I/O elements 411. The peripherals may send the array data by wired or wired less method to the processor 401. The array processing can also be done in the peripherals and send the processed clean speech or speech feature to the processor 401.

It is further noted that in some implementations, one or more sound sources 419 may be coupled to the apparatus 400, e.g., via the I/O elements or a peripheral, such as a game controller. In addition, one or more image capture devices 420 may be coupled to the apparatus 400, e.g., via the I/O elements or a peripheral such as a game controller.

As used herein, the term I/O generally refers to any program, operation or device that transfers data to or from the system 400 and to or from a peripheral device. Every data transfer may be regarded as an output from one device and an input into another. Peripheral devices include input-only devices, such as keyboards and mouses, output-only devices, such as printers as well as devices such as a writable CD-ROM that can act as both an input and an output device. The term "peripheral device" includes external devices, such as a mouse, keyboard, printer, monitor, microphone, game controller, camera, external Zip drive or scanner as well as internal devices, such as a CD-ROM drive, CD-R drive or internal modem or other peripheral such as a flash memory reader/writer, hard drive. By way of example, and not by way of limitation, some of the initial parameters of the microphone array 422, calibration data, and the partial parameters of the multivariate PDF and mixing and de-mixing data can be saved on the mass storage device 415, on CD-ROM, or downloaded from a remove server over the network 426.

The processor 401 may perform digital signal processing on signal data 406 as described above in response to the data 406 and program code instructions of a program 404 stored and retrieved by the memory 402 and executed by the processor module 401. Code portions of the program 404 may conform to any one of a number of different programming languages such as Assembly, C++, JAVA or a number of other languages. The processor module 401 forms a general-purpose computer that becomes a specific purpose computer when executing programs such as the program code 404. Although the program code 404 is described herein as being implemented in software and executed upon a general purpose computer, those skilled in the art may realize that the method of task management could alternatively be implemented using hardware such as an application specific integrated circuit (ASIC) or other hardware circuitry. As such, embodiments of the invention may be implemented, in whole or in part, in software, hardware or some combination of both.

An embodiment of the present invention may include program code 404 having a set of processor readable instructions that implement source separation methods as described above. The program code 404 may generally include instructions that direct the processor to perform source separation on a plurality of time domain mixed signals, where the mixed signals include mixtures of original source signals to be extracted by the source separation methods described herein. The instructions may direct the signal processing device 400 to perform a Fourier-related transform (e.g. STFT) on a plurality of time domain mixed signals to generate time-frequency domain mixed signals corresponding to the time domain mixed signals and thereby load frequency bins. The instructions may direct the signal processing device to perform independent component analysis as described above on the time-frequency domain mixed signals to generate estimated source signals corresponding to the original source signals. The independent component analysis will utilize mixed multivariate probability density functions that are weighted mixtures of component probability density functions of frequency bins corresponding to different source signals and/or different time segments.

It is noted that the methods of source separation described herein generally apply to estimating multiple source signals from mixed signals that are received by a signal processing device. It may be, however, that in a particular application the only source signal of interest is a single source signal, such as a single speech signal mixed with other source signals that are noises. By way of example, a source signal estimated by audio signal processing embodiments of the present invention may be a speech signal, a music signal, or noise. As such, embodiments of the present invention can utilize ICA as described above in order to estimate at least one source signal from a mixture of a plurality of original source signals.

Although the detailed description herein contains many specific details for the purposes of illustration, anyone of ordinary skill in the art will appreciate that many variations and alterations to the details described herein are within the scope of the invention. Accordingly, the exemplary embodiments of the invention described herein are set forth without any loss of generality to, and without imposing limitations upon, the claimed invention.

While the above is a complete description of the preferred embodiments of the present invention, it is possible to use various alternatives, modifications and equivalents. Therefore, the scope of the present invention should be determined not with reference to the above description but should, instead, be determined with reference to the appended claims, along with their full scope of equivalents. Any feature described herein, whether preferred or not, may be combined with any other feature described herein, whether preferred or not. In the claims that follow, the indefinite article "a", or "an" when used in claims containing an open-ended transitional phrase, such as "comprising," refers to a quantity of one or more of the item following the article, except where expressly stated otherwise. Furthermore, the later use of the word "said" or "the" to refer back to the same claim term does not change this meaning, but simply re-invokes that non-singular meaning. The appended claims are not to be interpreted as including means-plus-function limitations or step-plus-function limitations, unless such a limitation is explicitly recited in a given claim using the phrase "means for" or "step for."

What is claimed is:

1. A method of processing signals with a signal processing device, comprising:

receiving a plurality of time domain mixed signals in a signal processing device, each time domain mixed signal including a mixture of original source signals;

performing a Fourier-related transform on each time domain mixed signal with the signal processing device to generate time-frequency domain mixed signals corresponding to the time domain mixed signals; and performing independent component analysis on the time-frequency domain mixed signals to generate at least one estimated source signal corresponding to at least one of the original source signals, wherein the independent component analysis utilizes mixed multivariate probability density functions in which each said mixed multivariate probability density function is a weighted mixture of a plurality of component multivariate probability density functions, wherein different component multivariate probability density functions in each said mixed multivariate probability density function have different parameters which correspond to frequency bins for different source signals and/or different time segments.

2. The method of claim 1, wherein the mixed signals are audio signals.

3. The method of claim 2, wherein the mixed signals include at least one speech source signal, and the at least one estimated source signal corresponds to said at least one speech signal.

4. The method of claim 1, wherein said performing a Fourier-related transform comprises performing a short time Fourier transform (STFT) over a plurality of discrete time segments.

5. The method of claim 3, wherein said performing independent component analysis comprises utilizing an expectation maximization algorithm to estimate the parameters of the component multivariate probability density functions.

6. The method of claim 3, wherein said performing independent component analysis comprises utilizing pre-trained eigenvectors of clean speech in an estimation of the parameters of the component probability density functions.

7. The method of claim 6, wherein said performing independent component analysis further comprises utilizing pre-trained eigenvectors of music and noise.

8. The method of claim 6, wherein said performing independent component analysis further comprises training eigenvectors with run-time data.

9. The method of claim 2, further comprising converting the mixed signals into digital form with an analog to digital converter before said performing a Fourier-related transform.

10. The method of claim 2, further comprising performing an inverse STFT on the estimated time-frequency domain source signals to produce estimated time domain source signals corresponding to original time domain source signals.

11. The method of claim 3, wherein the component probability density functions have spherical distributions.

12. The method of claim 11, wherein the component probability density functions have Laplacian distributions.

13. The method of claim 11, wherein the component probability density functions have super-Gaussian distributions.

14. The method of claim 3, wherein the component probability density functions have multivariate generalized Gaussian distributions.

15. The method of claim 2, wherein said mixed multivariate probability density functions are weighted mixtures of component probability density functions of frequency bins corresponding to different sources.

16. The method of claim 2, wherein said mixed multivariate probability density functions are weighted mixtures of component probability density functions of frequency bins corresponding to different time segments.

17. The method of claim 3, wherein the mixed signals are received from a microphone array.

18. A signal processing device comprising:

a processor;

a memory; and computer coded instructions embodied in the memory and executable by the processor, wherein the instructions are configured to implement a method of signal processing comprising:

receiving a plurality of time domain mixed signals, each time domain mixed signal including a mixture of original source signals;

performing a Fourier-related transform on each time domain mixed signal to generate time-frequency domain mixed signals corresponding to the time domain mixed signals; and performing independent component analysis on the time-frequency domain mixed signals to generate at least one estimated source signal corresponding to at least one of the original source signals, wherein the independent component analysis utilizes mixed multivariate probability density functions in which each said mixed multivariate probability density function is a weighted mixture of a plurality of component multivariate probability density functions, wherein different component multivariate probability density functions in each said mixed multivariate probability density function have different parameters which correspond to frequency bins for different source signals and/or different time segments.

19. The device of claim 18, further comprising a microphone array for observing the time domain mixed signals.

20. The device of claim 18, wherein the processor is a multi-core processor.

21. The device of claim 18, wherein the mixed signals are audio signals.

22. The device of claim 21, wherein the mixed signals include at least one speech source signal, and the at least one estimated source signal corresponds to said at least one speech signal.

23. The device of claim 18, wherein said performing a Fourier-related transform comprises performing a short time Fourier transform (STFT) over a plurality of discrete time segments.

24. The device of claim 22, wherein said performing independent component analysis comprises utilizing an expectation maximization algorithm to estimate the parameters of the component multivariate probability density functions.

25. The device of claim 22, wherein said performing independent component analysis comprises utilizing pre-trained eigenvectors of clean speech in an estimation of the parameters of the component probability density functions.

26. The device of claim 25, wherein said performing independent component analysis further comprises utilizing pre-trained eigenvectors of music and noise.

27. The device of claim 25, wherein said performing independent component analysis further comprises training eigenvectors with run-time data.

28. The device of claim 22, further comprising an analog to digital converter, wherein said method further comprises converting the mixed signals into digital form with the analog to digital converter before said performing a Fourier-related transform.

29. The device of claim 22, the method further comprising performing an inverse STFT on the estimated time-frequency domain source signals to produce estimated time domain source signals corresponding to original time domain source signals.

30. The device of claim 22, wherein the component probability density functions have spherical distributions.

31. The device of claim 30, wherein the component probability density functions have Laplacian distributions.

32. The device of claim 30, wherein the component probability density functions have super-Gaussian distributions.

33. The device of claim 22, wherein the component probability density functions have multivariate generalized Gaussian distributions.

34. The device of claim 22, wherein said mixed multivariate probability density functions are weighted mixtures of component probability density functions of frequency bins corresponding to different sources.

35. The device of claim 22, wherein said mixed multivariate probability density functions are weighted mixtures of component probability density functions of frequency bins corresponding to different time segments.

36. A computer program product comprising a non-transitory computer-readable medium having computer-readable program code embodied in the medium, the program code operable to perform signal processing operations comprising:

receiving a plurality of time domain mixed signals, each time domain mixed signal including a mixture of original source signals;

performing a Fourier-related transform on each time domain mixed signal to generate time-frequency domain mixed signals corresponding to the time domain mixed signals; and performing independent component analysis on the time-frequency domain mixed signals to generate at least one estimated source signal corresponding to at least one of the original source signals, wherein the independent component analysis utilizes mixed multivariate probability density functions in which each said mixed multivariate probability density function is a weighted mixture of a plurality of component multivariate probability density functions, wherein different component multivariate probability density functions in each said mixed multivariate probability density function have different parameters which correspond to frequency bins for different source signals and/or different time segments.

* * * * *